US005103891A

United States Patent [19]

Sylvester et al.

[11] Patent Number: 5,103,891

[45] Date of Patent: Apr. 14, 1992

[54] RESURFACED WORN FLASK WALLS

[75] Inventors: James L. Sylvester; Alan P. Gould, both of Au Gres, Mich.

[73] Assignee: CMI International, Inc., Southfield, Mich.

[21] Appl. No.: 577,289

[22] Filed: Sep. 4, 1990

Related U.S. Application Data

[62] Division of Ser. No. 474,939, Feb. 5, 1990, Pat. No. 4,972,567.

[51] Int. Cl.[5] ..... B23P 6/00

[52] U.S. Cl. ..... 164/412; 29/403.14

[58] Field of Search ..... 29/402.09, 402.14, 402.15, 29/402.17, 402.18; 164/412

[56] References Cited

U.S. PATENT DOCUMENTS

| | | | |
|---|---|---|---|
| 1,592,609 | 7/1926 | Mattice | 29/402.12 X |
| 2,091,082 | 8/1937 | Osolin | 29/402.14 X |
| 2,216,784 | 10/1940 | Payre | 29/402.18 X |
| 3,824,628 | 4/1975 | Jarron et al. | 29/402.15 X |
| 4,547,941 | 10/1985 | Meier | 29/402.14 X |

*Primary Examiner*—Timothy V. Eley

*Attorney, Agent, or Firm*—Harness, Dickey & Pierce

[57] ABSTRACT

Worn interior wall surfaces of a sand casting flask cope or drag frame are resurfaced by covering the surfaces with thin, metal liner plates. The liner plates are bolted to the flask walls by bolts that extend through bolt holes in the liner plates and walls. The bolt holes through the plates are provided with deep countersinks for receiving the bolt heads and spacing the bolt heads beneath the exposed inner faces of the plates. Molten weld material is applied in such spaces for welding the bolts to the plates. A thin, hard coating of metal, such as chrome plating, is applied over the liner plate inner face and exposed weld material at the countersinks. Thereafter, the liner plate is removably fastened upon the inner surfaces of the flask frame by extending the bolts through the bolt holes in the frame wall and securing them in place with suitable nuts.

6 Claims, 1 Drawing Sheet

RESURFACED WORN FLASK WALLS

This is a divisional application of Application Ser. No. 07/474,939,filed Feb. 5, 1990, now U.S. Pat. No. 4972567.

BACKGROUND OF INVENTION

This invention relates to resurfacing the worn interior walls of a flash cope or drag frame which is used in sand casting molten metal. A typical foundry metal casting flask is formed of an upper, cope frame and a lower, drag frame which are aligned, one above the other, and filled with sand within which a molten metal casting cavity is formed. The sand packed within the boxed-like frames contacts the interior wall surfaces of the cope and drag.

After a period of use, the cope and drag frame interior surfaces become worn and uneven. Such wear is particularly found where a single flask is used repeatedly to make sand cakes for flask-less molds. That is, in that system of casting, sand is packed within a flash cope and drag around a pattern positioned within the frames. The frames are separated vertically and the pattern is removed, following which the frames are realigned one upon the other.

Subsequently, the flask is removed from the packed sand mold or cake. The flask is immediately reused for forming the next sand mold or cake. Meanwhile, the finished sand mold is removed, without the flask, and molten metal is poured into its cavity for casting a metal object therein.

The removal of the flask from the packed sand abrades the interior wall surfaces of the flask frames which causes wear and unevenness. That unevenness can cause the exterior surface of the packed sand mold to stick to, or to interlock with crevices or scratches upon, the worn flask inner surfaces that damage the sand mold and make it more difficult to separate from the flask. Thus, it is desirable to maintain the interior wall surfaces of the flask cope and drag frames in a relatively smooth, unscratched and undamaged condition.

In the present practice, when the interior walls of a flask cope or drag frame become damaged or worn, the flask must be completely replaced or, alternatively, the inner surfaces must be machined flat and smooth if possible. Either choice is relatively expensive and time consuming. Where the glask is replaced entirely, the purchase of an expensive, new flask is necessary. Thus, this invention is concerned with a system for resurfacing the interior worn faces of a cope and drag frame.

SUMMARY OF INVENTION

An open top and bottom, box-like frame which may form either the cope or drag of a sand casting flask, has its interior wall surfaces repaired by covering them with liner plates. The liner plates are formed of this, flat metal having outer faces for face-to-face engagement with the interior surfaces of the walls and inner faces which provide the resurfacing.

The liner plates are bolted to the flask walls so that they may be applied and removed for replacement when desired. Before applying the first liner plates, the worn inner wall surfaces of the flask may be ground relatively level and flat to form a support base for the liner. Subsequent liner plate replacement ordinarily does not require levelling the flask well surfaces.

In order to bolt the liners to the walls, a large number of bolt holes are formed in each of the liners. These bolt holes are provided with deep countersinks at their inner faces so that bolts may be positioned within the holes with their bolt heads deeply inset within the plates. That is, the bolt heads are spaced a distance beneath the plane of the inner face of the liner plate. Next, molten weld material is applied, by using a conventional welding process, within the countersinks to weld the bolts in place. Excess weld metal, which forms a bump over the countersink openings is ground flat. Thus, the inner face of each of the plates is smooth and the exposed surfaces of the welds are co-planar with the surfaces of the inner face.

The plates are applied against their respective flask wall surfaces with their welded-in-place bolts extending through bolt receiving holes that are pre-drilled in the flask walls. Nuts are applied to the ends of the bolts for fastening the plates to the walls. Thus, the plates are rigidly, but removably fastened within the flask frames to provide replaceable resurfacing.

An object of this invention is to provide inexpensive, but sturdy and long lasting liners which are bolted within the frames of a flask for rapidly, and inexpensively, repairing worn flasks for reuse.

A further object of this inventio is to provide a means for repeatedly resurfacing the interior wall surfaces of a conventional cope or drag frame used in a foundry for sand casting.

Another object of this invention is to provide a means for inexpensively fastening a liner plate within the interior of a flask frame so that the liner plate may be rapidly applied or removed so as to minimize the downtime of an automatic sand mold forming machine within which the flask is used to form flask-less sand molds.

These and other objects and advantages of this invention will become apparent upon reading the following description, of which the attached drawings form a part.

DETAILED DESCRIPTION

Figure 1:
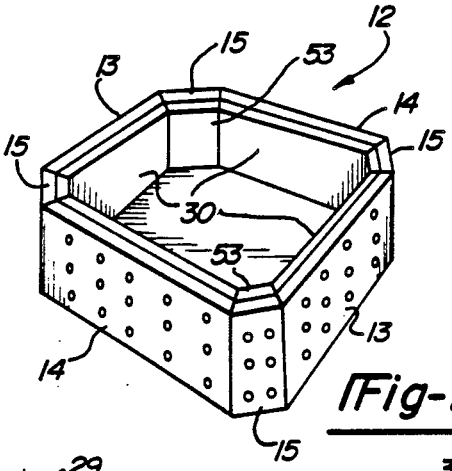
FIG. 1 is a perspective view of the drag frame of a flask, shown schematically.
Figure 2:
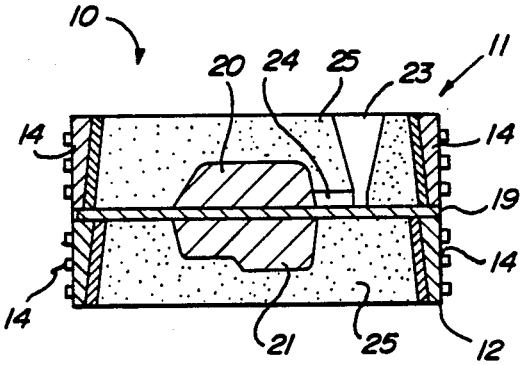
FIG. 2 is a schematic, elevational, cross sectional view of an assembled flask, with the cope positioned upon the drag and with a match plate with patterns arranged within the sand filling.

FIG. 2 schematically illustrates, in cross section, a flask 10 having a cope frame 11 positioned upon a drag frame 12. The cope and drag frames are box-like in shape and have opposite end walls 13 and opposite side walls 14 which are interconnected by corner wall strips 15. Some conventional flasks are rectangular in configuration, that is, with sharp corners and other conventional flasks may have angled corners as illustrated in FIG. 1.

As shown schematically in FIG. 2, a match plate 19 is arranged between the cope and drag frames. The match plate has an upper pattern half 20 extending into the cop and a lower pattern half 21 extending into the drag. In addition, a suitable sprue pin 23 or the like is provided to form a flow passageway for molten metal. Also, a gate forming element 24 is provided for flowing molten metal into a cavity formed in the packed sand by the pattern halves.

The cope and drag are packed with a sand filling 25. Conventionally, first the drag is filled with sand by pouring sand into the drag while it is rested upon the match plate. The sand surrounds the lower pattern half 21, which at this point is at the bottom of the drag. Then, the drag is inverted so that the match plate is on top. The cope is lowered upon the drag and sand is poured into the cope. The sand fillings in the cope and drag may be squeezed towards the match plate for compacting the sand around the pattern. Next, the cope and drag are separated and the match plate and patterns are removed. Replacing the cope upon the drag, produces a casting cavity within them for the receipt of molten metal which is poured into the inlet passageway formed by the sprue pin 23 and the gage element 24.

In automatic sand mold making machines, a single flask may be repeatedly used to rapidly form sand molds in the manner set forth above. When each sand mold is completed, the cope and drag frames are separated from the cake or sand mold which then is moved on a conveyor to a place where molten metal is poured into the flask-less sand mold. Alternatively, in some operations, the flask frame remains with the sand until after the metal is cast and solidified. Then the flask and sand are separated so that the flask may be reused. In that case, numerous flasks are used.

Figure 3:
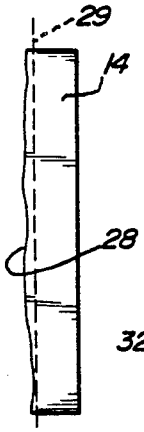
FIG. 3 is an enlarged, schematic, sectional view of a portion of the wall of the cope or drag frames with the roughened or worn surface greatly exaggerated.

In a high production foundry, whether the flask is used to make flask-less sand molds or used together with the sand, there is considerable wear upon the wall surfaces of the flask. Thus, as schematically, illustrated in FIG. 3, the interior wall surface 29 becomes rough, scratched or otherwise damaged by the abrading action of the sand.

Typically, drag walls should be smooth and flat. In some cases, the cope walls may be flat, and in other cases they may be provided with horizontal grooves or lines for better retaining the sand filling when thay are lifted above the drag for removal of the patterns. However, regardless as to whether the cope and drag frames are completely flat and smooth or have grooves in their surfaces, they become unusable after a period of use.

Once the interior wall of the flask frame is roughened or damaged, it becomes necessary to either replace the flask with a new one or, alternatively, rework the surface to smooth it and bring it back to its original finish. Either replacing the frame or refinishing the frame walls is relatively expensive and time consuming. It requires stocking additional frames and may result in considerable down-time in the case of refinishing the flask walls in an automatic mold forming machine which uses a single flask for making flask-less molds. Thus, this invention is concerned with providing a refinished interior surface for the flask, quickly, inexpensively, and with minimal labor and down-time and to permit reusing worn flasks.

The first step in reusing a worn flaask is to refinish the interior wall surface, as illustrated schematically by the dotted line 29, so as to provide a relatively flush or flat support surface for a liner plate. Once that is accomplished, it usually is not necessary to repeat that operation in further replacing liner plates.

Next, a liner plate 30 is provided for each of the major walls 13 and 14 of the flask. The plate is preferably formed of flat, relatively thin, high quality steel which has an outer face 31 arranged for face-to-face contact against the flask wall interior face 29, and an inner face 32 against which the sand is compacted. The liner is sized to substantially completely cover the interior surface of the frame wall.

The liner is secured to the frame wall by means of suitable bolts. Thus, each liner is provided with a number of bolt holes 35 through which a bolt may be inserted. Each bolt hole is formed with a countersink 36 at the liner inner face. Preferably, the countersink is conical in shape with its larger base at the surface of the inner face.

Aligned bolt holes are formed in the flask walls 37 so that each pair of aligned liner and wall bolt holes receives a bolts 39. The head 40 of each bolt is closely fitted within the countersink of its respective bolt hole. However, the countersink is relatively deep so that the bolt head is depressed or spaced beneath the plane defining the inner face 32 of its plate.

Figure 6:
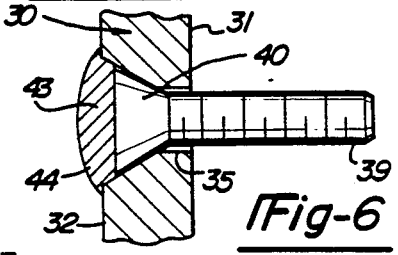
FIG. 6 is an enlarged, fragmentary, cross sectional view showing the initial weld deposit which welds the bolt to the liner plate.
Figure 7:
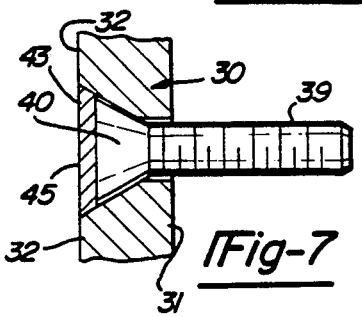
FIG. 7 is an enlarged, schematic, fragmentary view, similar to FIG. 6, showing the exposed surface of the weld deposit ground into the plane of the plate face.
Figure 8:
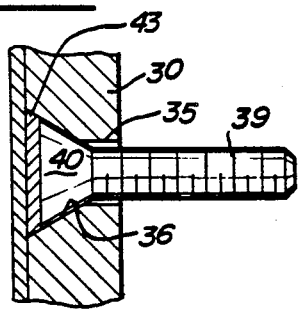
FIG. 8 is a view similar to FIG. 7 showing chrome plating applied to the liner.
Figure 9:
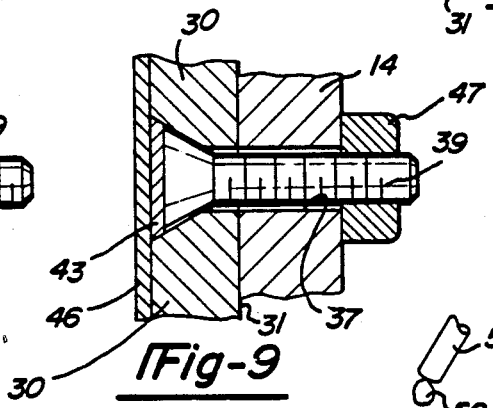
FIG. 9 is a view similar to FIG. 8 showing the assembly of the liner plate to the frame wall.

The space 41 left in the countersink above the bolt head, when the bolt head is inserted, is subsequently filled with a deposit of weld metal 43. As illustrated in FIG. 6, when the weld metal is deposited, in a molten puddle, excess weld metal forms a bump-like deposit portion 44. That is, when the weld metal solidifies, it not only welds the bolt in place and fills the space 41, but it also leaves an inwardly arranged bump or roughness. That bump is ground down, as for example, by use of a rotary surface grinder, until its exposed surface 45 is co-planar with the inner face 32 of the plate.

Figure 4:
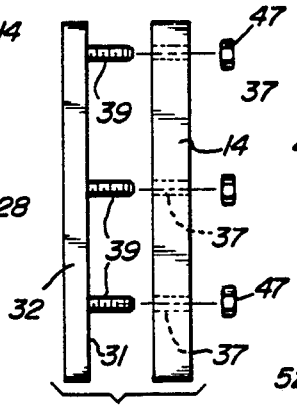
FIG. 4 is a schematic, enlarged view showing the relative positions of the liner plate and frame wall just prior to assembly to the adjacent frame wall.
Figure 5:
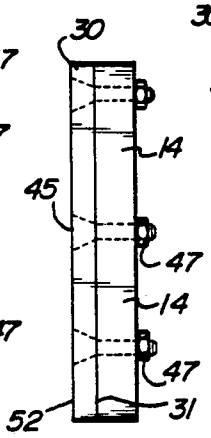
FIG. 5 is an enlarged, schematic view showing the liner secured to its corresponding frame wall.

After the bolts have been welded in place and the deposits have been ground flush with the plate surface, the inner face of the liner plate is coated with a hard metal surface. For example, a relatively thin, chrome surface is plated upon the surface, including over the exposed weld deposit surface 45. By way of example, the chrome plating may be on the order of 0.010 inches thick. Then, the liner plate is aligned with its respective frame wall, as illustrated in FIG. 4, and moved until its bolts extend through the corresponding bolt holes 37 in the wall. The bolts are fastened in place by means of suitable nuts 47. This permits removing the liner for replacement with a fresh liner when the liner becomes worn or damaged.

In depositing the molten weld metal in the countersinks, there is a danger that the relatively thin liner may become wavy or bent or buckled due to the localized application of heat. Thus, the weld deposit can be made by partially submerging the liner plate within a water bath provided by a pan 49 containing water 50. A small portion of the liner plate is located above the surface of the water. For example, if the liner plate is about ⅜ of an inch in thickness, roughly the upper ⅛ of an inch of the plate may be positioned above the level of the water. The thickness of the liner plate and the amount projecting above the water bath may very considerably, depending upon the plate size and materials and the requirements for making a particular flask. Therefore, the above dimension is merely illustrative.

Figure 10:
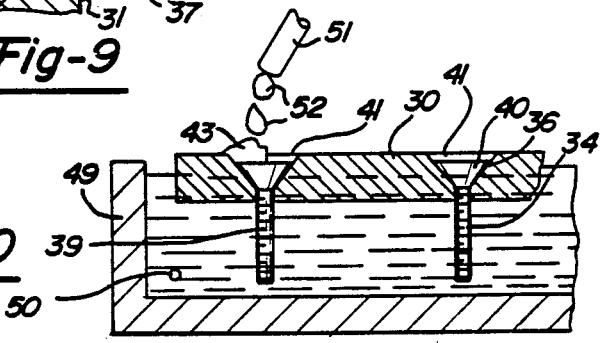
FIG. 10 is an enlarged, fragmentary, schematic view showing depositing the weld metal upon a liner submerged within a water bath.

As shown in FIG. 10, a typically welding rod 51 is arranged above the countersink which contains a bolt head 40. Droplets of molten weld metal 52 are deposited in the countersink, upon the bolt head, to form a molten metal puddle which solidifies.

Where the flask includes angled corners, as illustrated by the corner strips 15, narrow corner liners 53 are applied. These may be provided with bolt holes, bolts and weld deposits, in the same manner as described above in connection with the liners used for the major surfaces of the walls of the flask.

As can be seen, the method described above permits repeatedly reusing worn flasks by resurfacing the interior worn wall surfaces as necessary. Thus, a single flask may be used until its surface requires liners and, thereafter, each time the liners become worn, they can be replaced with fresh liners. This considerably extends the life of a flask and permits relatively inexpensive and rapid repair of a flask. In the case of automatic sand mold making machinery, which use a single flask, the relining can be performed on that flask by shutting down the equipment for a short time. The down-time for relining a flask is minimal, as for example, a matter of minutes, which reduces lost production time.

In some cases, it may be desired to line a new flask, before it used, so that the liner, rather than the flask, takes the wear. From time to time new liners are installed, as required. In that case, the smoothing of the walls of a worn flask is eliminated.

This invention may be further developed within the scope of the following claims. Accordingly, it is desired that the foregoing description be read as being merely illustrative of an operative embodiment of this invention and not in a strictly limiting sense.

Having fully described an operative embodiment of this invention, we now claim:

1. A resurfacing for a worn interior wall surface of a desired configured wall of a flask cope or drag frame which is formed in a box-like configuration having upright walls for containing packed sand within which a molten metal casting cavity is formed, comprising:

a flat, thin, metal liner plate having a size and shape corresponding to the desired configuration of the wall of a flask cope or drag frame to cover the worn wall surface said liner plate having an outer face for arrangement in face-to-face contact with the worn wall surface and an inner face for providing a resurface face for the worn frame wall surface;

bolt holes extending through the liner plate and aligned with corresponding bolt holes formed in the flask wall to be resurfaces, enlarged bolt head receiving countersinks formed in the plate inner face adjacent said bolt holes;

bolts extending through the aligned liner plate and wall bolt holes and with the bolt heads positioned within their respective bolt hole countersinks, and the bolt heads being of a size and shape to substantially fill the countersinks, but being spaced a short distance beneath the plane of the liner plate inner face to provide a space between the end surfaces of the bolt heads and the plane of the plate inner face;

weld metal filling the spaces in the countersinks between the bolt heads and the plane of the plate inner face, with said weld metal filling being coplanar with the plate inner face;

and with the bolts being secured to the flask wall for immovably fixing the liner plate within the frame to provide the resurfacing.

2. A construction as defined in claim 1, and including a thin, hard, smooth metal plating applied upon the inner face of the liner plate and exposed weld metal at the countersinks.

3. A construction as defined in claim 2, and with said frame having four major, substantially flat wall interior surfaces, and including similar resurfacing applied to each of said wall surfaces.

4. A construction as defined in claim 2, and including said bolts having portions extending through and beyond the frame walls and being secured to the frame walls by nuts removably applied to the bolt portions which extend through the frame walls so that the liners may be applied and removed for replacement.

5. Resurfaced worn flask walls with worn interior wall surfaces defining a sand casting flask cope or drag frame which is formed in a box-like configuration having upright walls for containing packed sand within which a molten metal casting cavity is formed, comprising:

flat, thin, metal liner plates having a size and shape corresponding to the desired configuration of the wall of a flask cope or drag frame to cover substantially the entire worn, interior wall surfaces of the frame, said liner plates having an outer face for engagement in face-to-face contact with the worn wall surface and an inner face for providing a resurfaced frame wall interior surface;

bolt holes extending through the liner plates and aligned with corresponding bolt holes formed in the flask walls which are covered by the liner plate, with the plate bolt holes having enlarged, bolt head receiving countersinks that are formed at the plate inner face;

bolts extending through the aligned liner plate and wall bolt holes and countersinks, and with the bolt heads each positioned within their respective bolt hole countersinks and being of a size and shape to substantially fill their respective countersinks, but being spaced a short distance beneath the plane of the liner plate inner face;

weld metal filling the spaces in the countersinks between the bolt heads and the plane of the plate inner face and the filling being co-planar with the plate inner face of each respective bolt head;

and with the bolts being secured to their respective flask walls for immovably fixing the liner plate within the frame.

6. A construction as defined in claim 5, and including said countersinks being substantially conical in wall shape with their corresponding bolt heads being similarly shaped for closely fitting within their respective countersinks.

* * * * *